US011459709B2

(12) United States Patent
De Sars et al.

(10) Patent No.: US 11,459,709 B2
(45) Date of Patent: Oct. 4, 2022

(54) ASPHALT MIXING PLANT

(71) Applicant: ERMONT, Lorette (FR)

(72) Inventors: Thierry De Sars, Bron (FR); Laurent Gatel, Sorbiers (FR)

(73) Assignee: ERMONT, Lorette (FR)

( * ) Notice: Subject to any disclaimer, the term of this patent is extended or adjusted under 35 U.S.C. 154(b) by 874 days.

(21) Appl. No.: 16/353,753

(22) Filed: Mar. 14, 2019

(65) Prior Publication Data

US 2019/0284770 A1 Sep. 19, 2019

(30) Foreign Application Priority Data

Mar. 15, 2018 (FR) ..... 18 52224

(51) Int. Cl.

| | |
|---|---|
| ***E01C 19/00*** | (2006.01) |
| ***E01C 19/08*** | (2006.01) |
| ***E01C 19/05*** | (2006.01) |
| ***B65D 88/30*** | (2006.01) |
| *E01C 19/10* | (2006.01) |

(52) U.S. Cl.

CPC ..... *E01C 19/08* (2013.01); *B65D 88/30* (2013.01); *E01C 19/05* (2013.01); *E01C 19/10* (2013.01)

(58) Field of Classification Search

CPC ..... E01C 19/08; E01C 19/10; E01C 19/05
See application file for complete search history.

(56) References Cited

U.S. PATENT DOCUMENTS

| | | | |
|---|---|---|---|
| 4,248,359 | A | 2/1981 | Brock |
| 5,362,193 | A | 11/1994 | Milstead |
| 5,433,575 | A | 7/1995 | Milstead |
| 9,427,782 | B2 | 8/2016 | Ayres |
| 9,863,101 | B2 | 1/2018 | Mollick et al. |
| 10,005,106 | B2 | 6/2018 | Ayres |
| 10,155,251 | B2 | 12/2018 | Ayres |
| 2005/0103791 | A1 | 5/2005 | Gerding |

(Continued)

FOREIGN PATENT DOCUMENTS

| | | |
|---|---|---|
| CN | 2515229 Y | 10/2002 |
| EP | 1227187 A1 | 7/2002 |
| GB | 2 329 378 | 3/1999 |

(Continued)

OTHER PUBLICATIONS

European Search Report for Application No. 19 16 3263 dated May 20, 2019.

(Continued)

*Primary Examiner* — Anshu Bhatia

(74) *Attorney, Agent, or Firm* — Nixon & Vanderhye

(57) ABSTRACT

An asphalt mixing plant includes several transportable modules, each module being formed by a normalized transport container in which at least one of the primary pieces of equipment of the asphalt mixing plant is incorporated, the primary equipment being installed permanently in the container while being mounted stationary in the container or mounted movable in the container between a transport position and a usage position, at least one of the modules including a placement device incorporated into the container and configured to position the container as a whole relative to the ground and/or to position a movable primary piece of equipment in the usage position relative to the container.

20 Claims, 5 Drawing Sheets

(56) References Cited

U.S. PATENT DOCUMENTS

| | | | | |
|---|---|---|---|---|
| 2019/0100886 | A1* | 4/2019 | Eliot | E01C 19/08 |
| 2019/0119866 | A1* | 4/2019 | Baumrind | B01F 29/63 |

FOREIGN PATENT DOCUMENTS

| | | | |
|---|---|---|---|
| WO | 94/19263 | A1 | 9/1994 |
| WO | 2015/073981 | A1 | 5/2015 |
| WO | 2016/196877 | A1 | 12/2016 |

OTHER PUBLICATIONS

French Search Report, dated Dec. 5, 2018, from corresponding FR application No. 1852224.

* cited by examiner

ASPHALT MIXING PLANT

The present invention relates to a plant for mixing asphalt from aggregates, in particular asphalt for road covering.

In order to mix asphalt for road covering from aggregates, it is possible to store the aggregates in metering hoppers, dry the aggregates in a drying drum by circulating aggregates and a stream of hot gases in the drying drum, mix the aggregates with a binder, then load the aggregates in trucks using a conveyor, optionally by providing a storage hopper at the outlet of the conveyor.

It may prove necessary to install an asphalt mixing plant near a worksite, in a hard-to-access location. The worksite is for example a worksite for creating a new road or for first application of asphalt on a dirt road.

One of the aims of the invention is to propose an asphalt mixing plant that can be transported easily and placed easily in a given location, potentially difficult to access.

To that end, the invention proposes a plant for mixing asphalt from aggregates, the asphalt mixing plant comprising primary pieces of equipment for mixing asphalt chosen from among at least metering hoppers for storing and metering aggregates, a drying drum for drying aggregates in a hot gas stream, a filtering device for filtering hot gas leaving the drying drum, an elevating conveyor for conveying the mixed asphalts by lifting them relative to the ground, and a storage hopper for storing the mixed asphalts at a height relative to the ground, the asphalt mixing plant comprising several transportable modules, each module being formed by a normalized transport container in which at least one of the primary pieces of equipment is incorporated, the primary piece of equipment being installed permanently in the container while being mounted fixed in the container or mounted movably in the container between a transport position and a usage position, at least one of the modules comprising a placement device incorporated into the container and configured to position the container as a whole relative to the ground and/or to position a movable primary piece of equipment in the usage position relative to the container.

The asphalt mixing plant made up of modules comprising normalized transport containers containing the primary pieces of equipment of the plant facilitates the transport of the asphalt mixing plant in a disassembled transport configuration, by road, railway or sea. The asphalt mixing plant can thus be sent easily to various locations.

The placement devices incorporated into the containers make it possible to mount the asphalt mixing plant by moving a container as a whole or moving a primary piece of equipment received in a container from a transport position to a usage position.

A placement device for example comprises a mechanical connection connecting the primary piece of equipment to the container (articulation, guideway, etc.), a maintaining device making it possible to keep the primary equipment in the usage position (support foot, stop, etc.) and/or an actuator making it possible to generate a force in order to move the container as a whole relative to the ground or the primary equipment received in the container relative to the container.

According to specific embodiments, the asphalt mixing plant comprises one or several of the following features, considered individually or according to all technically possible combinations:

- the device for placing at least one of the modules comprises at least one retractable support member incorporated into the container of the module, each support member being able to be deployed in order to position the container relative to the ground or retracted in the container in order to transport the container;
- the device for placing at least one of the modules comprises at least one actuator configured to move the container as a whole relative to the ground;
- the device for placing at least one of the modules having a primary piece of equipment mounted moving in the container, comprises at least one positioning member configured to position the primary piece of equipment relative to the container in an elevated usage position relative to a lowered transport position;
- the placement device of the module comprises an actuator configured to raise the primary piece of equipment from the transport position to the usage position;
- the primary piece of equipment extends along an extension axis and has a first end and a second end, the primary piece of equipment being articulated on the container near its first end so as to be rotatable between a lowered transport position and a raised usage position in which the extension axis is inclined while forming a non-zero angle with the horizontal;
- the primary piece of equipment is an elevating conveyor;
- the module further comprises, among the primary pieces of equipment, a storage hopper mounted at the second end of the elevating conveyor;
- the storage hopper is mounted movably on the elevating conveyor between an unfolded usage position and a folded transport position in which the hopper is folded down against the elevating conveyor to make it possible to lower the elevating conveyor into the transport position;
- the container of the module comprises two doors arranged opposite one another in two opposite side walls of the container, the opening of the doors making it possible to arrange a passage for a vehicle through the container, the passage passing below at least part of the primary piece of equipment in the elevated usage position;

The modules comprise a metering module comprising, among the primary pieces of equipment, several metering hoppers mounted inside the container of the metering module, a drying module comprising, among the primary pieces of equipment, a drying drum mounted inside the container of the drying module, and/or a filtering module comprising, among the primary pieces of equipment, a filtering device;

- it comprises a drying module comprising, among the primary pieces of equipment, a drying drum mounted inside the container of the drying module; and a filtering module comprising, among the primary pieces of equipment, a filtering device, the filtering module being configured to be stacked on the drying module, with connecting a hot gas manifold positioned at an outlet end of the drying drum to an inlet of the filtering device.

According to another aspect, the invention relates to a transportable loading module for an asphalt mixing plant, the transportable loading module comprising a normalized transport container, an elevating conveyor installed permanently in the container while being at least partially mounted movably on the container between a transport position in which the elevating conveyor is lowered relative to the container and received inside the container and a usage position in which the elevating conveyor is raised relative to the container, and a storage hopper configured to receive and store asphalts poured by the elevating conveyor during use, and in which the container comprises two doors arranged opposite one another in two opposite side walls of the container, the opening of the doors making it possible to arrange a passage for a vehicle through the container, the passage passing below the storage hopper, for the loading of the vehicle width asphalts poured by the elevating conveyor.

In specific embodiments, the loading module comprises one or several of the following optional features, considered individually or according to all technically possible combinations:

- the elevating conveyor comprises a stationary part mounted stationary on the container and a moving part mounted moving on the container to move from the transport position to the usage position of the elevating conveyor;
- the elevating conveyor is mounted movably as a whole relative to the container;
- it comprises a placement device configured to keep the elevating conveyor in the usage position relative to the container and/or to move the elevating conveyor relative to the container between the transport position and the usage position;
- it comprises at least one positioning member configured to keep the elevating conveyor in the usage position;
- a positioning member is a support foot making it possible to keep the elevating conveyor in the usage position;
- it comprises an actuator configured to move the elevating conveyor from the transport position to the usage position;
- the actuator is a jack having one end connected to the container and one end connected to the elevating conveyor;
- an extension of the actuator raises the elevating conveyor and a contraction of the actuator lowers the elevating conveyor;
- it comprises an articulation assembly connecting the elevating conveyor to the container such that the elevating conveyor is mounted rotatably on the container between the transport position and the usage position;
- the articulation assembly comprises an arm having one end fastened rigidly to the elevating conveyor and the other end mounted pivoting on the container;
- the storage hopper is mounted on the end of the elevating conveyor that is raised relative to the other when the elevating conveyor is in the usage position;
- the storage hopper is mounted movably on the elevating conveyor between a folded position for transport and an unfolded usage position, the storage hopper in the folded position being folded down against the elevating conveyor to make it possible to lower the elevating conveyor into the transport position thereof.

The invention also relates to a plant for mixing asphalt from aggregates, the asphalt mixing plant comprising a loading module as defined above.

According to specific embodiments, the asphalt mixing plant comprises one or several of the following optional features, considered individually or according to all technically possible combinations:

- it comprises primary pieces of equipment including for mixing asphalt chosen from among at least metering hoppers for storing and metering aggregates, a drying drum for drying aggregates in a hot gas stream, optionally a filtering device for filtering hot gas leaving the drying drum, the elevating conveyor and the storage hopper, the asphalt mixing plant comprising several transportable modules including the loading module, each module being formed by a normalized transport container in which at least one of the primary pieces of equipment is incorporated, the primary piece of equipment being installed permanently in the container while being mounted fixed in the container or mounted movably in the container between a transport position and a usage position;
- at least one retractable support member incorporated into the container of the module, each support member being able to be deployed in order to position the container relative to the ground or retracted in the container in order to transport the container;
- at least one of the modules comprises at least one actuator configured to move the container as a whole relative to the ground;
- the modules comprise a metering module comprising a container and the metering hoppers mounted inside this container, a drying module comprising a container and the drying drum mounted inside this container, and/or a filtering module comprising a container and the filtering device mounted inside this container;
- it comprises a drying module comprising a normalized transport container and a drying drum mounted inside this container, and a filtering module comprising a normalized transport container and a filtering device mounted inside this container, the filtering module being configured to be stacked on the drying module, with connecting a hot gas manifold positioned at an outlet end of the drying drum, to an inlet of the filtering device;
- the drying module comprises a placement device incorporated into the drying module and configured to simultaneously lift the drying module and the filtering module stacked on the drying module;
- at least one of the modules comprises a placement device incorporated into this module, the placement device comprising actuators to lift the container of this module relative to the ground and retractable feet provided to keep the container raised relative to the ground;
- the actuators of the device for placement of a module are arranged to act on the feet of the placement device of this module;
- the actuators of the device for placement of a module are separated from the feet of the placement device of this module.

The invention and its advantages will be better understood upon reading the following description, provided solely as a non-limiting example, and done in reference to the appended drawings, in which.

Figure 1:
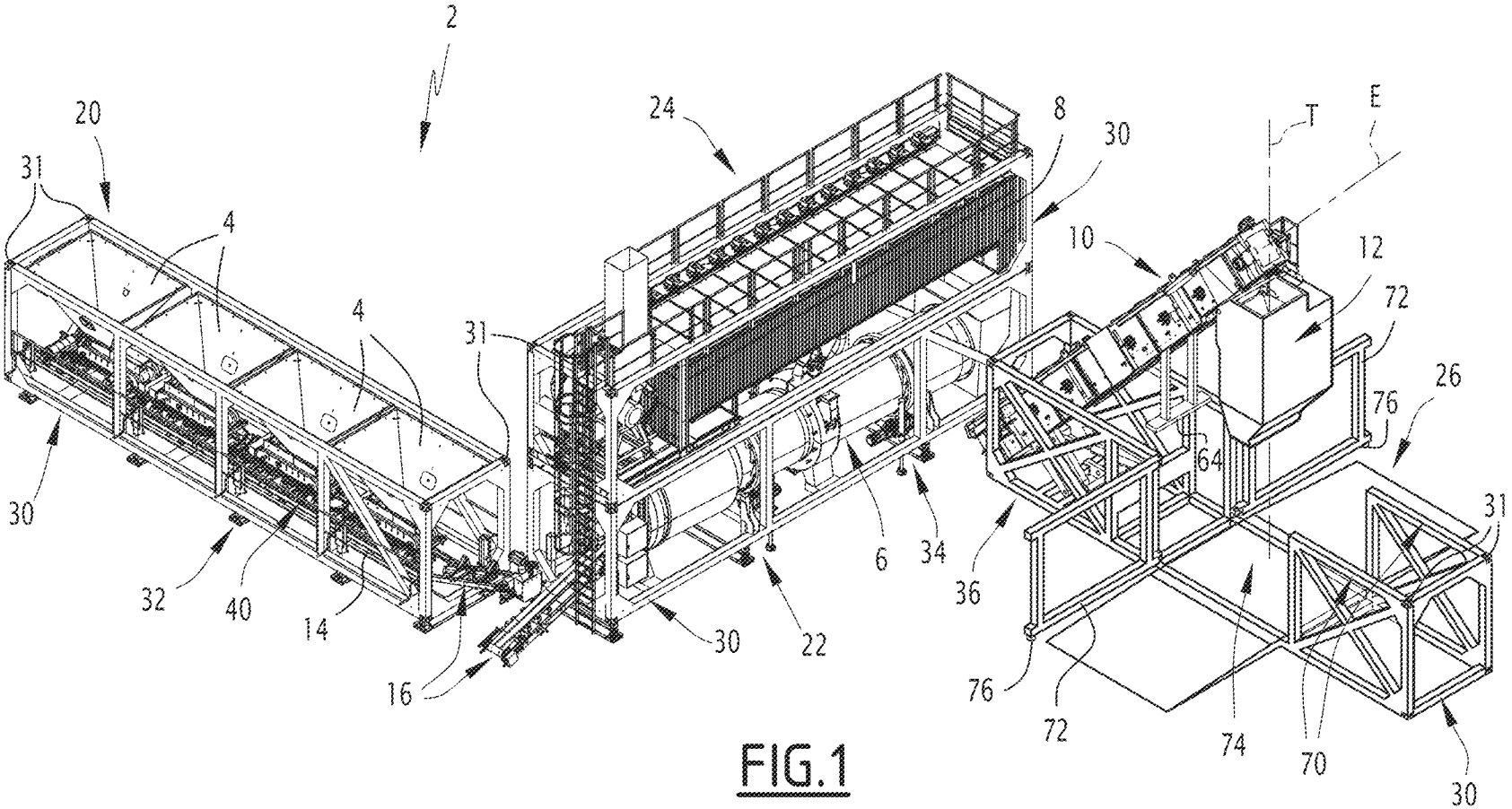
FIG. 1 is a perspective view of an asphalt mixing plant mounted in a usage configuration and ready to be used.

The asphalt mixing plant 2 of FIG. 1 is configured to mix asphalt from aggregates, in particular road covering asphalt.

The asphalt mixing plant 2 comprises primary pieces of equipment for mixing asphalt chosen from among metering hoppers 4 for storing and metering aggregates, a drying drum 6 for drying aggregates in a hot gas stream, a filtering device 8 for filtering hot gas leaving the drying drum, an elevating conveyor 10 for conveying the mixed asphalts by lifting them relative to the ground, and a storage hopper 12 for storing the mixed asphalts at a height relative to the ground.

Optionally, the primary pieces of equipment are further chosen from among a fuel storage tank, a binder storage tank, a storage silo for powdered products, a control cab and/or a screening, storage, metering and/or mixing tower.

A screening, storage, metering and/or mixing tower is for example used for production of the discontinuous type, in which dried aggregates are next screened, stored, metered and mixed with binder in batches.

The primary pieces of equipment are the equipment making it possible to carry out the main steps of asphalt mixing from aggregates, in particular the metering of the aggregates, the drying of the aggregates in a hot gas stream, the mixing and/or working of the aggregates with the binder to obtain the asphalt, and the distribution of the asphalt, through an elevating conveyor and a storage hopper located at a height to pour the asphalt into a transport vehicle and/or applicator.

These primary pieces of equipment are generally the bulkiest and/or the heaviest, such that it is difficult or even impossible to handle them manually without the assistance of a placement device.

The asphalt mixing plant 2 may further comprise auxiliary pieces of equipment, i.e. pieces of equipment allowing the operation of the primary pieces of equipment and/or the connection between the primary pieces of equipment.

The auxiliary pieces of equipment for example comprise a transport conveyor 14 arranged so as to recover the aggregates metered at the outlet of the metering hoppers 4, and/or an intermediate conveyor 16 to transfer the metered aggregates from the transport conveyor 14 to a drying drum.

The asphalt mixing plant 2 comprises several transportable modules 20, 22, 24, 26, each module 20, 22, 24, 26 being formed by a normalized transport container 30 in which at least one of the primary pieces of equipment of the asphalt mixing plant is incorporated, the primary pieces of equipment being installed permanently in the container 30 while being mounted stationary in the container 30 or mounted movable in the container 30 between a transport position and a usage position.

A "normalized transport container" designates a container specifically designed for road, rail and/or maritime transport. Such a container is also called "international transport container" or "intermodal transport container" or "maritime transport container".

Each container 30 is for example according to standard ISO 668 and/or standard ISO 1496.

Each container 30 has corner parts 31 located at the eight apices of a rectangular rhomb. These corner parts 31 are spaced apart precisely and have normalized anchoring openings. These corner parts 31 are used to moor the containers 30 and/or fasten the containers 30 to one another.

Each container 30 may have, as desired, a length of 10 feet, 20 feet, 30 feet, 40 feet, 45 feet. In the illustrated asphalt mixing plant, each container 30 for example has a length of 40 feet.

Each container 30 may have solid or open-worked walls. In the illustrated asphalt mixing plant 2, each container 30 has open-worked side walls.

More specifically, each container 30 is made up of a framework composed of members connected to one another by connection points, the framework having a generally parallelepiped shape, the corner parts 31 being present at the eight apices of the generally parallelepiped shape.

Each module 20, 22, 24, 26 comprises a primary piece of equipment or several primary pieces of equipment received in the container 30 of said module 20, 22, 24, 26.

Each module 20, 22, 24, 26 is designed such that each primary piece of equipment received in the container 30 of said module 20, 22, 24, 26 stays in the container 30 in the usage configuration of the asphalt mixing plant 2.

In other words, the container 30 of each module 20, 22, 24, 26 defines a support structure for the primary piece of equipment received in said container 30 in the transport configuration and in the usage configuration.

Thus, each container 30 is not only used to store primary pieces of equipment for transport, but defines the structure of the asphalt mixing plant 2 in the usage configuration of the asphalt mixing plant 2.

In particular, the asphalt mixing plant 2 can be placed without handling a primary piece of equipment to completely remove it from a container 30 of a module 20, 22, 24, 26. The primary piece of equipment stays in the container 30 in the usage configuration of the asphalt mixing plant 2.

Each primary piece of equipment mounted stationary in a container 30 stays in the same position for the transport of the container 30 and during the use of the asphalt mixing plant 2.

Each primary piece of equipment mounted moving in a container 30 is moved between a transport position, allowing the handling and transport of the container 30, and a usage position, allowing the use of the asphalt mixing plant 2.

Each primary piece of equipment mounted moving in a container 30 is movable in part relative to the container, only part of the primary piece of equipment being movable, another part of the primary piece of equipment being mounted stationary in the container 30, or moving as a whole relative to the container 30 between the transport position and the usage position, the primary piece of equipment being mounted moving in one piece relative to the container 30.

In one example embodiment, the primary piece of equipment in the usage configuration at least partially protrudes from the container 30, while remaining mounted on the container 30, and of course in the transport position, the primary piece of equipment is fully received inside the container 30, without protruding from the parallelepiped enclosure defined by the container 30, in particular by the corner parts 31.

At least one of the modules 20, 22, 24, 26 comprises a placement device 32, 34, 36 incorporated into the container 30 and configured to position the container 30 as a whole relative to the ground and/or to position a primary piece of equipment in the usage position relative to the container 30.

The term "incorporated" means that the placement device 32, 34, 36 remains permanently on the container 30, during transport and use. The placement device 32, 34, 36 is an integral part of the container 30. It is not removable and withdrawn for transport and added for placement.

"Position relative to the ground" means that the container 30 can be kept at a determined height relative to the ground and/or inclined relative to the ground, while being inclined relative to the horizontal.

The term "horizontal" is understood here relative to a planar and horizontal surface on which the container 30 is placed.

In one example embodiment, at least one of the modules 20, 22, 24, 26 comprises an integrated placement device 32, 34, 36 making it possible to keep the container 30 in position relative to the ground and/or to position the container 30 relative to the ground.

Such a placement device 32, 34, 36 for example comprises one or several retractable support members integrated into the container 30 in order to keep the container 30 in position relative to the ground and/or at least one actuator to move the container 30 relative to the ground.

The presence of one or several actuator(s) makes it possible to move the container 30 as a whole relative to the ground, the presence of one or several support members making it possible to keep the container 30 in the desired position.

Each support member is for example movable between a position retracted inside the container 30 and one or several deployed position(s) in which the support member bears on the ground to keep the container 30 in position relative to the ground.

Providing several deployed positions makes it possible to adjust the height of the container 30 relative to the ground and/or to compensate for irregularities in the ground.

Each support member is for example configured to be locked in one or several deployed position(s).

Each actuator is configured to generate a movement force of the container 30 relative to the ground.

Each actuator for example comprises a member movable between a retracted position for transport and a deployed position to bear on the ground in order to move the container 30 relative to the ground.

Each actuator is for example a manual actuator, a pneumatic actuator, a hydraulic actuator or an electrical actuator. A manual actuator is for example actuated manually by means of a crank, a wheel or a lever.

Each actuator is for example a jack, for example a jack able to be actuated manually, a pneumatic jack, a hydraulic jack or an electric jack.

Figure 2:
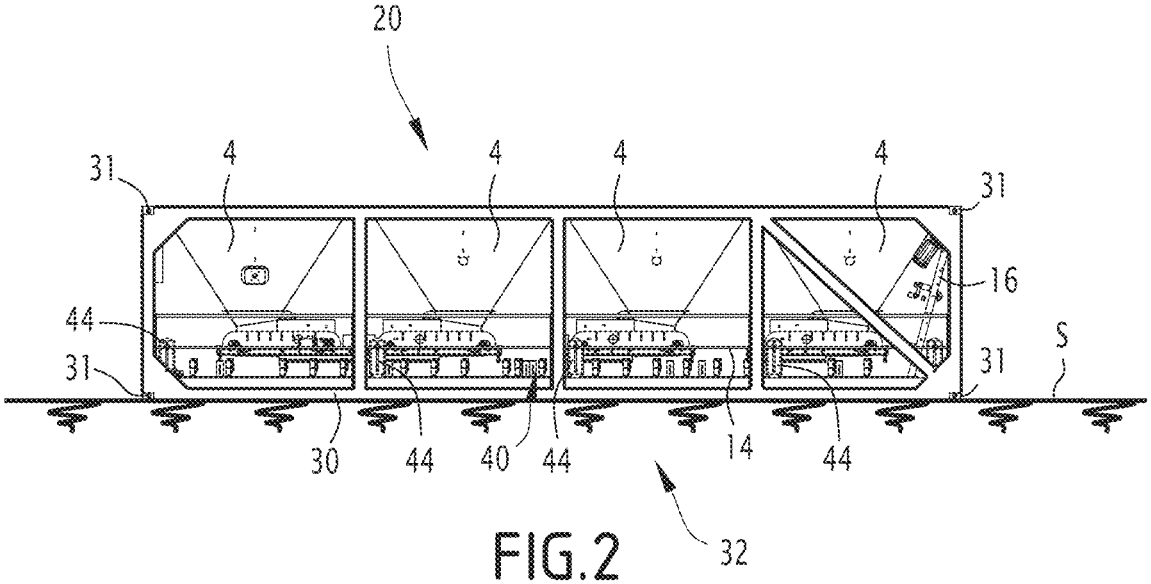
FIGS. 2 and 3 are side views of a metering module of the asphalt mixing plant, respectively in a transport configuration and a usage configuration.
Figure 3:
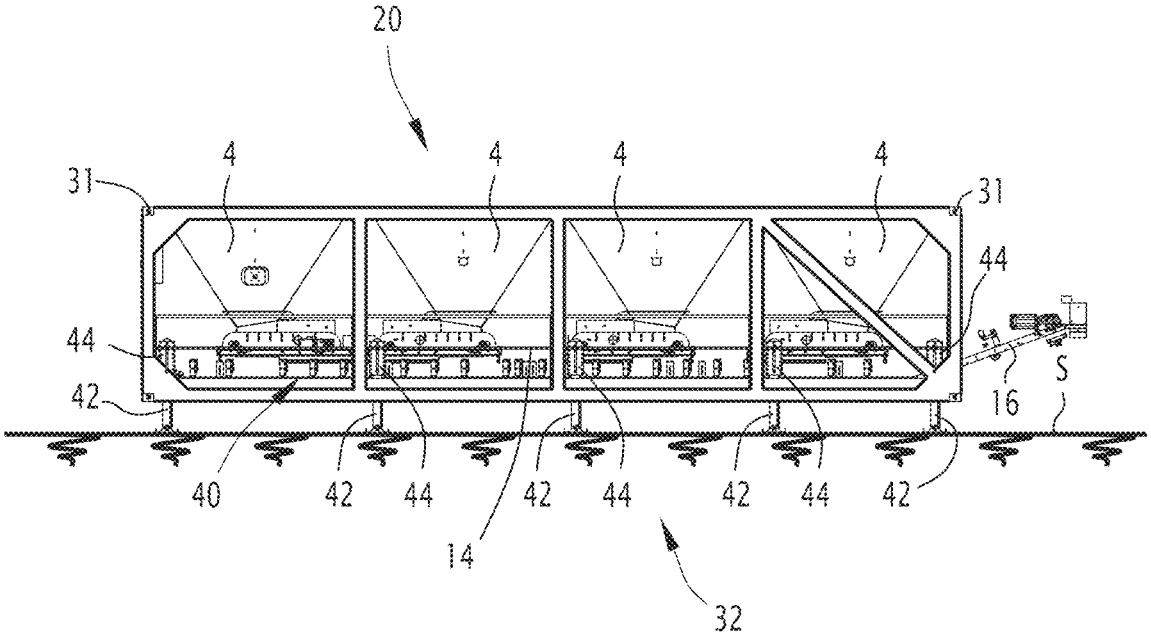

In the illustrated example, the modules 20, 22, 24, 26 of the asphalt mixing plant 2 comprise a metering module 20 (FIGS. 1, 2 and 3) comprising a container 30 and several metering hoppers 4 arranged in the same container 30.

Each metering hopper 4 is mounted stationary in the container 30 of the metering module 20. The metering hoppers 4 here are arranged in a line along the length of the container 30.

Optionally, the container 30 of the metering module 20 comprises a transport conveyor 40 arranged in the direction of the length of the container 30 to pass below the metering hoppers 4 in order to recover the aggregates at the outlets of the metering hoppers and bring them to one end of the container 30.

The metering module 20 here comprises a placement device 32 comprising support members in the form of retractable feet 42 distributed along the container 30 of the metering module (here there are six) and/or actuators 44 in order to move the container 30 relative to the ground.

Each foot 42 is movable between a position retracted inside the container 30 (FIG. 2) and one or several deployed position(s) (FIG. 3) in which the foot 42 bears on the ground S to keep the container 30 relative to the ground.

Each foot 42 is advantageously configured to be able to be locked in several different positions.

Each actuator 44 here is arranged to act on a respective foot 42 in order to force its movement in the deployed position to raise the container 30 above the ground. Alternatively, the actuators 44 are separated from the feet 42.

The modules 20, 22, 24, 26 of the asphalt mixing plant 2 comprise a drying module 22 (FIGS. 1, 4 and 5) comprising a drying drum 6 mounted stationary in the container 30.

The drying drum 6 comprises a generally cylindrical enclosure 46 extending along a central axis A, the enclosure 46 being mounted rotating about its central axis A and having an inlet end 46A for introducing aggregates and an outlet end 46B for recovering the aggregates, dried and/or mixed with a binder.

The asphalt mixing plant 2 comprises a burner 48 for generating hot gases and circulating them inside the drum and a hot gas manifold 50 arranged at one end of the drying drum 6 for collecting the hot gases having circulated in the drying drum 6.

In the illustrated example, the burner 48 is arranged at one end of the drying drum 6 so as to form a flame F inside the drying drum 6 and the hot gas manifold 50 is arranged at the other, opposite end of the drying drum 6.

In the illustrated example, the burner 48 is arranged at the inlet end 46A, the aggregates and the hot gases then circulating in the same direction in the drying drum 6. The drying drum 6 is said to have parallel currents or co-currents.

Alternatively, the burner 48 is arranged at the outlet end 46B. The aggregates and the hot gases then circulate in opposite directions in the drying drum 6. The drying drum 6 is said to be counter-current.

In one possible variant, the drying module 22 does not have a burner integrated into the drying drum 6.

The asphalt mixing plant 2 for example comprises a hot gas generating device separated from the drying drum 6. During the placement of the asphalt mixing plant, the hot gas production device can easily be connected to the drying drum 6 using a hot gas pipe.

Optionally, the drying drum 6 is a drying and mixing drum configured to mix the aggregates with a binder introduced into the drying drum 6.

The drying module 22 comprises a placement device 34 comprising a plurality of support members in the form of retractable feet 52 integrated into the container 30 and/or at least one actuator 54 for moving the container 30 relative to the ground.

Figure 4:
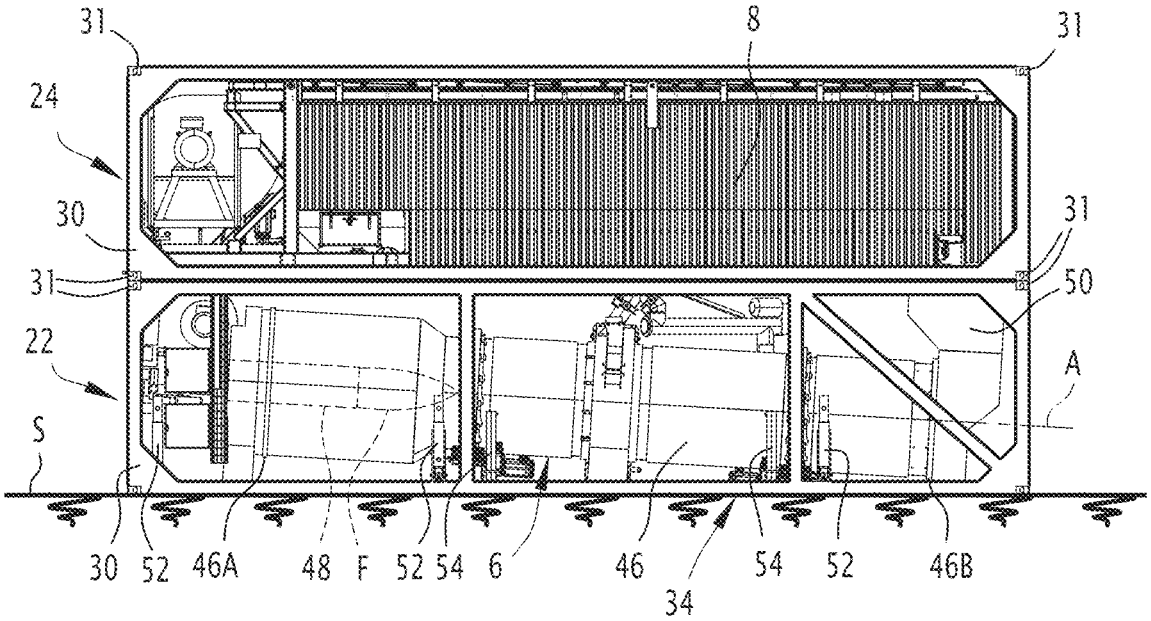
FIGS. 4 and 5 are side views of a drying module and a filtering module of the asphalt mixing plant, respectively in a transport configuration and a usage configuration.
Figure 5:
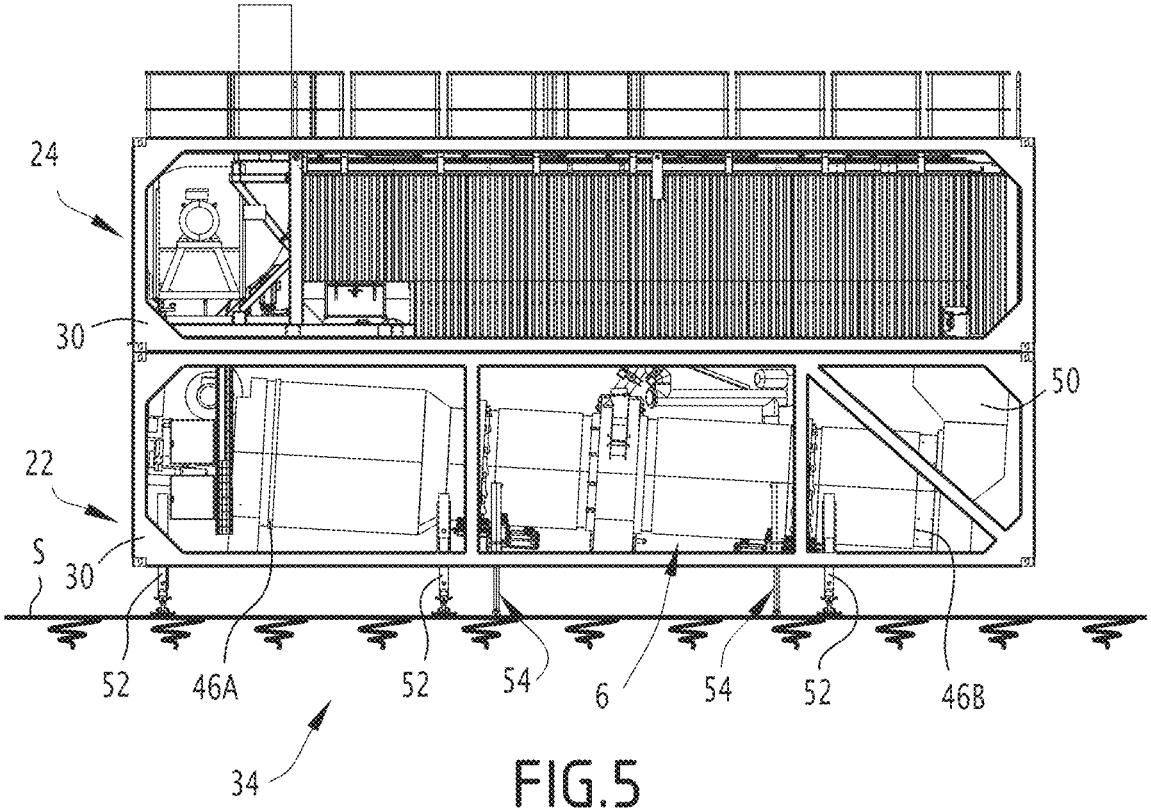

In the transport configuration, the feet 52 and, if applicable, the actuators 54 are retracted and the container 30 is placed on the ground (FIG. 4). In the usage configuration, the actuators 54 have been used to raise the container 30 relative to the ground S into the desired position, and the feet 52 have been deployed to keep the container 30 in position relative to the ground.

The actuators 54 here are separated from the feet 52. Alternatively, the actuators 54 are configured to act on the feet 52 in order to deploy them or retract them selectively.

The asphalt mixing plant 2 comprises a filtering module 24 (FIGS. 1, 4 and 5) comprising a container 30 and the filtering device 8 mounted stationary in the container 30 of the filtering module 24.

The filtering device 8 is configured to recover the hot gases collected by the manifold 50 and to filter them before discharging them into the atmosphere. The filtering device 8 for example traditionally comprises filtering sleeves.

The filtering module 24 here is configured to be stacked on the drying module 22, i.e., to be placed over or stacked on the drying module 22. The filtering device 24 has an inlet provided to be connected to the outlet of the hot gas manifold 50.

The placement device 36 of the drying module 22 is configured to simultaneously lift the drying module 22 and the filtering module 24 stacked on the drying module 22.

In particular here, the actuators 54 of the placement device 36 of the drying module 22 are configured to simultaneously lift the drying module 22 and the filtering module 24 stacked on the drying module 22.

Some container 30 transport trucks are equipped with lifting tools making it possible to unload a container 30 onto another container 30 placed on the ground.

The placement device 36 of the drying module 22 here makes it possible, with such a truck, to stack the filtering module 24 on the drying module 24, then to raise the drying module 22 with the filtering module 24 placed on top.

The asphalt mixing plant 2 comprises a loading module 26 (FIGS. 1, 6 and 7) comprising a container 30 and an elevating conveyor 10 mounted moving inside the container of the loading module 26.

The loading module 26 comprises an integrated placement device 36 making it possible to move the elevating conveyor 10 between a transport position and a usage position.

Figure 6:
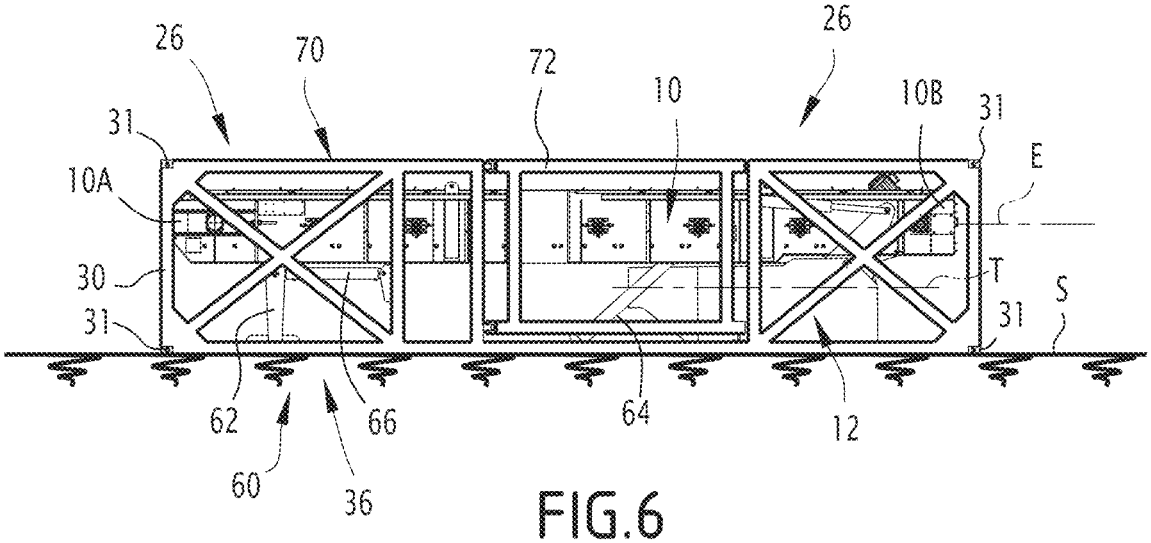
FIGS. 6 and 7 are side views of a loading module of the asphalt mixing plant, respectively in a transport configuration and a usage configuration midway between the transport configuration and a usage configuration visible in FIG. 1.

In the transport configuration, the elevating conveyor 10 extends inside the container 30 and along the length of the container 30 (FIG. 6).

For example, the elevating conveyor 10 in the transport configuration extends substantially horizontally inside the container 30. Alternatively, the elevating conveyor 10 in the transport position has an incline relative to the horizontal.

In the usage configuration, the elevating conveyor 10 is raised, so as to be able to convey the asphalts while raising them.

The elevating conveyor 10 here extends along an extension axis E.

In the usage position, the extension axis E forms a non-nil angle with the horizontal. The elevating conveyor 10 extends upward from a first lower end 10A intended to be connected to the outlet of the drum 6, to a second upper end 10B intended to discharge the asphalts.

The elevating conveyor 10 is at least partially mounted moving relative to the container between the transport position and the usage position.

Figure 7:
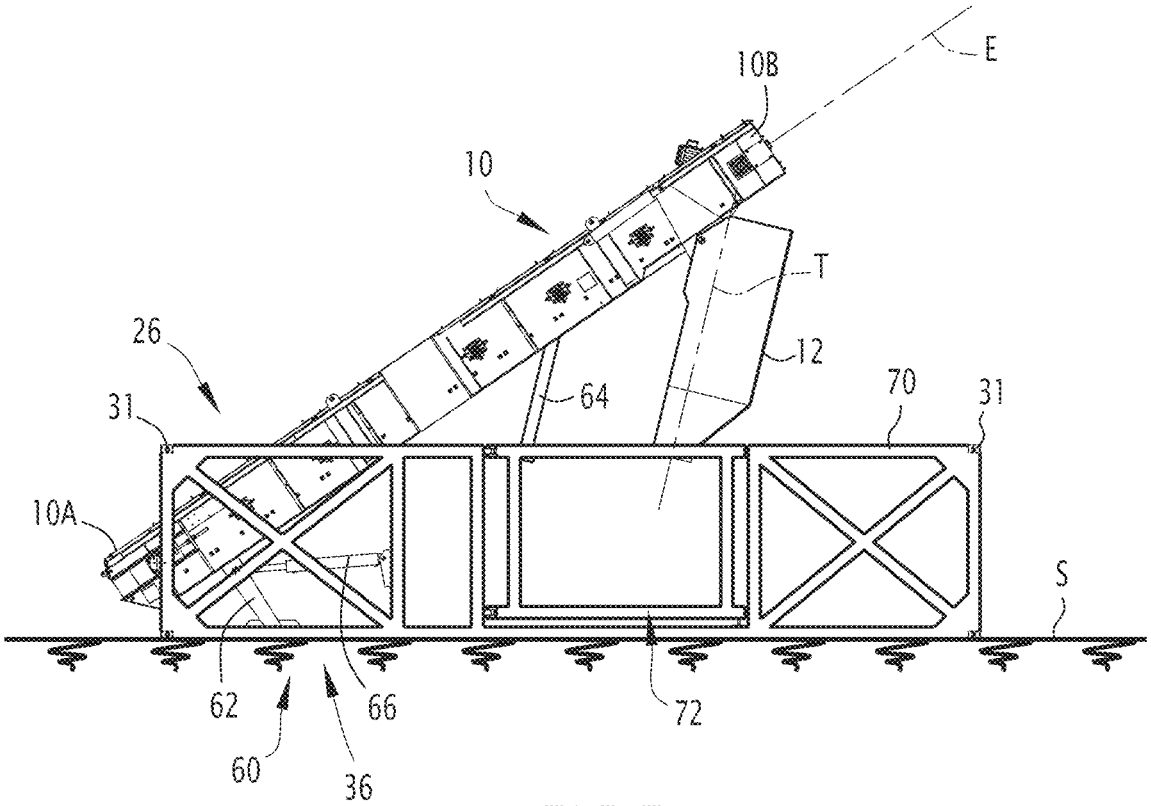

As illustrated in FIGS. 6 and 7, the elevating conveyor 10 is for example movable as a whole or in its entirety relative to the container 30, i.e., without folding into several segments. The elevating conveyor 10 is formed in one segment movable relative to the container 30 between the usage position and the transport position. This makes it possible to preserve an elevating conveyor 10 with a simple design.

The placement device 36 of the loading module 26 for example comprises an articulation assembly 60 connecting the elevating conveyor 10 to the container 30 such that the elevating conveyor 10 is mounted rotatably on the container 30, between the transport position and the usage position.

The placement device 36 here comprises an arm 62 (FIGS. 6 and 7) having one of its ends rigidly fastened to the elevating conveyor 10 and the other of its ends mounted pivoting on the container 30.

The placement device 36 optionally comprises a support foot 64 mounted on the elevating conveyor and making it possible to keep the conveyor in the usage position against its own weight.

The placement device 36 optionally comprises an actuator 66 configured to move the elevating conveyor 10 between the transport position and the usage position.

The actuator 66 is for example a manual actuator, a pneumatic actuator, a hydraulic actuator and/or an electrical actuator.

The actuator 66 here is a jack having one end connected to the container 30 and one end connected to the elevating conveyor, here more particularly to the arm bearing the elevating conveyor 10.

For example, the extension of the actuator 66 tends to lift the elevating conveyor 10, while the contraction of the actuator 66 tends to lower the elevating conveyor 10.

The actuator 66 is for example a manual jack, a pneumatic jack, a hydraulic jack and/or an electric jack.

Optionally, the loading module 26 comprises a storage hopper 12 configured to store asphalts unloaded by the elevating conveyor 10. The storage hopper 12 is suspended from the second end 10B of the elevating conveyor 10.

The storage hopper 12 is for example mounted moving on the elevating conveyor 10 between a folded position (FIG. 6) for transport and an unfolded position (FIG. 1) for use of the loading module 26.

The storage hopper 12 extends along a hopper axis T intended to be substantially vertical during use of the storage hopper 12.

In the unfolded position, the hopper axis T extend substantially vertically below the second end 10B of the elevating conveyor 10. The asphalts conveyed by the elevating conveyor 10 fall by gravity into the storage hopper 12.

In the folded position, the storage hopper 12 is folded against the elevating conveyor 10 so as to be able to lower the elevating conveyor 10 into the transport position. The hopper axis T is substantially parallel to the extension axis E of the elevating conveyor 10 (FIG. 6). When the elevating conveyor 10 is lowered, the storage hopper 12 is elongated below the elevating conveyor 10.

The storage hopper 12 is for example articulated at the second end 10B of the elevating conveyor 10 to be able to go from the second folded position to the unfolded position and vice versa.

This particular arrangement makes it possible to transport the elevating conveyor 10 and the storage hopper 12 compactly in a same container 30 and to deploy the storage hopper 12 due to the deployment of the elevating conveyor 10, the storage hopper 12 remaining mounted at all times at the second end 10B of the elevating conveyor 10.

In the usage configuration of the loading module 26, the storage hopper 12 is located above the container 30 of the loading module 26.

The container 30 of the loading module 26 is configured to allow the passage of a vehicle transversely through the container 30, below the storage hopper 12.

The container 30 here comprises two opposite side walls 70, each side wall 70 respectively bearing a door 72 movable between a closed position, in which the door is incorporated into the wall of the container 30, and an open position, in which the door 72 frees a passage 74 for a vehicle through the side wall 70.

The two doors 72 are provided on the two larger side walls 70 of the container 30.

The two doors 72 are opposite one another, such that when the doors 72 are open, the two doors allow the passage of a vehicle transversely through the container 30, below the storage hopper 12.

Each door 72 is for example mounted pivoting around a substantially vertical axis between its closed position and its open position.

Advantageously, at least one of the two doors 72, and preferably each door 72, is configured to form a stabilizer when it is in the open position.

To that end, the door 72 is for example configured to be blocked in the open position while forming a non-nil angle with the side wall 70 in which the door 72 is provided, for example while being substantially perpendicular to the side wall 70 in which the door 72 is provided.

Thus, the door 72 opposes any tilting of the container 30. This is particularly advantageous given that the elevating conveyor 10 in the usage position rises higher than the container 30 and can generate a significant tilting moment.

Optionally, the door 72 is provided with an adjustable shim device 76 (FIG. 1) positioned at a lower free end of the door, the shim device 76 being configured to bear on the ground.

In the illustrated example, each door 72 has an upper horizontal beam and a lower horizontal beam that are connected to one another by two vertical beams, the beams giving the door 72 a rectangular shape. The upper horizontal beam of each door 72 forms a portion of the length of the upper horizontal member of a side wall of the container 30.

In one variant, a door arranged in a side wall of the container 30 is formed solely by a length portion of the upper horizontal member of said side wall. This length portion is removable, while preferably being articulated to make it possible to free it to define the transverse passage through the container 30.

In the example illustrated in FIGS. 6 and 7, the elevating conveyor 10 of the loading module 26 is movable as a whole relative to the container 30.

Figure 8:
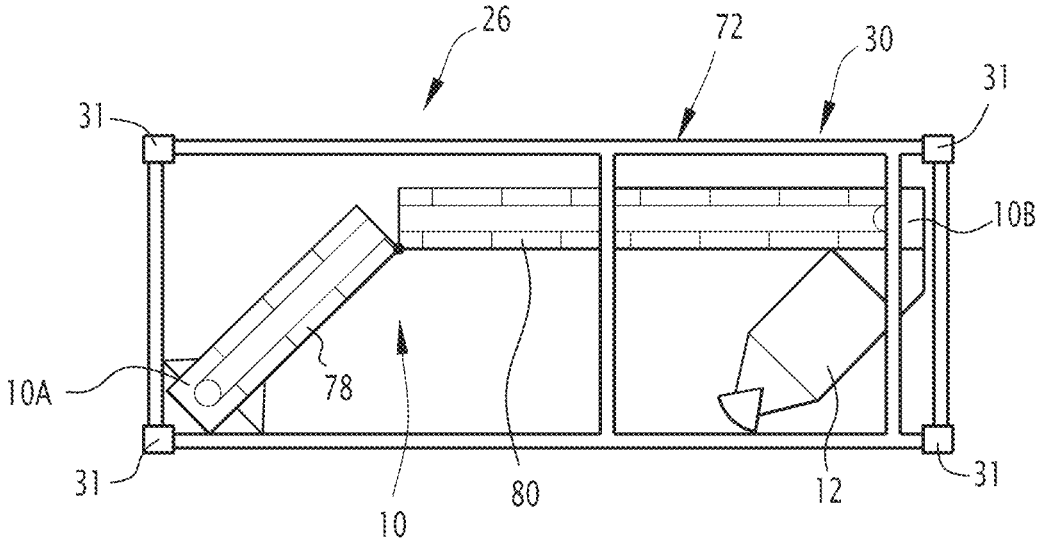
FIGS. 8 and 9 are views similar to those of FIGS. 6 and 7, illustrating a loading module according to one variant.
Figure 9:
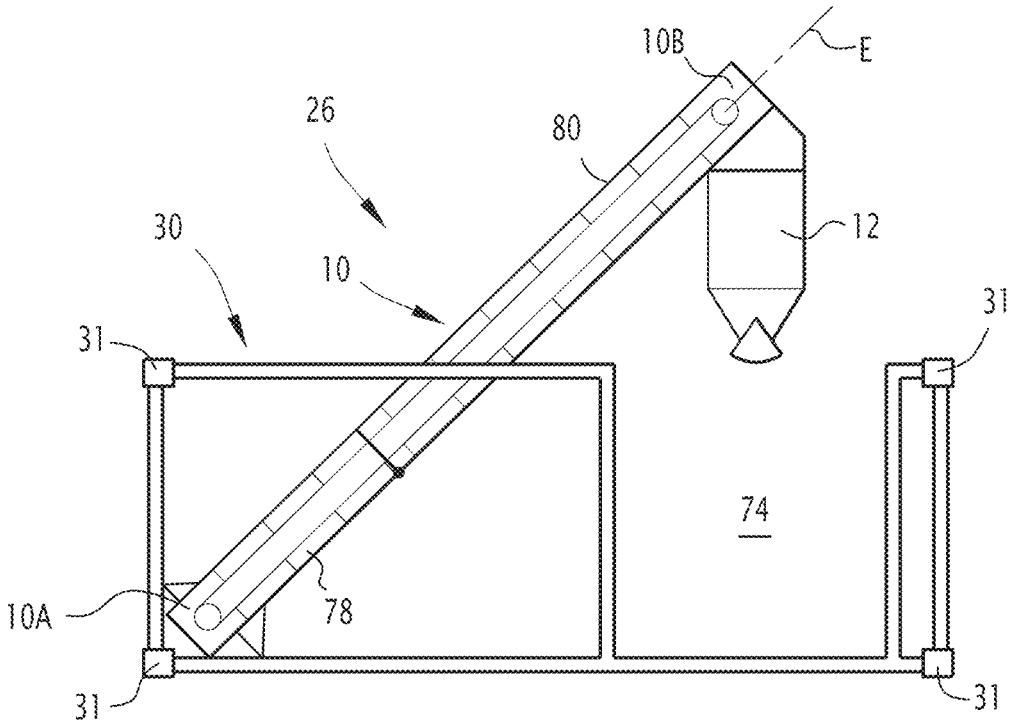

Alternatively, as illustrated in FIGS. 8 and 9, the elevating conveyor 10 is partially mobile and partially stationary relative to the container 30, the movement of the movable part making it possible to take the elevating conveyor 10 from its usage position to its transport position.

In this case, the elevating conveyor 10 comprises at least one stationary segment (stationary part) and at least one movable segment (movable part), the movement of each movable segment relative to the container 30 making it possible to go from the transport position to the usage position.

As illustrated in FIGS. 8 and 9, the elevating conveyor 10 comprises a stationary segment 78 and a movable segment 80 movable relative to the container 30 in order to take the elevating conveyor 10 from the transport position (FIG. 8) to the usage position (FIG. 9).

In the usage position, the stationary segment 78 and the movable segment 80 are aligned along the extension axis E of the elevating conveyor 10 in the usage position. In the transport position, they form a non-zero angle relative to one another. Here, the stationary segment 78 extends obliquely while the movable segment 80 extends substantially horizontally in the container 30.

The stationary segment 78 is the lower part of the elevating conveyor 10 and the movable segment 80 is the upper part of the elevating conveyor 10.

The storage hopper 12 is for example supported by the movable segment 80, at its end opposite the stationary segment 78 and forming the upper second end 10B of the elevating conveyor 10 in the usage position of the latter.

The storage hopper 12 is mounted permanently on the movable segment 80. In particular, it stays mounted thereon in the usage configuration.

The storage hopper 12 can be mounted stationary on the moving segment 80, like in the example illustrated in FIGS. 8 and 9, or movable to allow it to be folded, similarly to the example illustrated in FIGS. 6 and 7.

Like before, in the usage configuration, the storage hopper 12 is located above the container 30, which has side doors 72 able to be closed (FIG. 8) in the transport configuration or open (FIG. 9) in the usage configuration, in order to form a passage 74 through the container 30 for a vehicle to be loaded from the storage hopper 12.

For the transport of the asphalt mixing plant, the placement devices 32, 34, 36 of the modules 20, 22, 24, 26 of the asphalt mixing plant 2 are placed in the transport configuration.

In the illustrated example, for example relating to the metering module 20 and the drying module 22, the retractable feet 42, 52 and the actuators 44, 54 of the containers 30 are retracted. Regarding the loading module 26, the storage hopper 12 is folded, the elevating conveyor 10 is lowered and the doors 72 are closed.

In this configuration, each module 20, 22, 24, 26 can be transported easily, on a road vehicle, a rail vehicle or a ship, like any normalized transport container.

For the placement of the asphalt mixing plant 2, the containers 30 are unloaded in appropriate locations relative to one another. In particular, the container 30 of the filtering module 24 is stacked on the container 30 of the drying module 22.

Next, the placement devices 32, 34, 36 integrated into the modules 20, 22, 24, 26 are implemented to place the asphalt mixing plant 2.

The feet 42 and/or the actuators 44 of the metering module 20 are deployed to position the metering module at a desired height relative to the ground. The feet 52 and/or the actuators 54 of the drying module 22 are deployed in order to position the drying module 22 (and the filtering module 24) at a desired height relative to the ground. The placement device 36 of the loading module 26 is implemented to raise the elevating conveyor 10, unfold the storage hopper 12 and open the doors 72 in order to define a passage through the container 30.

The asphalt mixing plant 2 can thus be placed without needing a massive lifting tool distinct and separate from the modules of the asphalt mixing plant.

The asphalt mixing plant can be placed easily in a hard-to-reach location, without it further being necessary to bring in a lifting tool such as a crane.

The invention is not limited to the example embodiments described above and illustrated in the Figures.

In one possible variant, a device for placing a module configured to position a container 30 as a whole or to position a primary piece of equipment mounted movably on the container 30, can be provided without an actuator to generate a force for lifting the container 30 or the primary piece of equipment.

The lifting can be done using a lifting tool distinct and separate from the module, for example a crane, the placement device allowing the maintenance of the position of the container 30 relative to the ground and/or the primary piece of equipment relative to the container 30.

Thus, according to possible variants, the metering module 20 comprises a placement device 32 comprising retractable feet but with no actuator for lifting the container 30, the drying module 22 comprises a placement device 34 comprising retractable feet but with no actuator for moving the container 30 and/or the loading module 26 comprises a placement device 36 comprising an articulation and/or a support foot but with no actuator for lifting the elevating conveyor 10.

Furthermore, instead of providing a loading module 26 comprising an elevating conveyor 10 mounted movably on the container between a lowered transport position and a raised transport position, it is possible to provide an elevating conveyor 10 mounted stationary on the container 30, and to provide a placement device 36 configured to keep the container 30 as a whole in a raised usage position in which the container 30 is inclined relative to the horizontal to place the elevating conveyor 10 in the desired inclined position relative to the horizontal, the placement device optionally being configured to move the container as a whole between the lowered transport position and the raised usage position.

In this case, the storage hopper 12 can be mounted movably on the second end of the elevating conveyor 10 or on the container 30 so as to be located below the second end of the elevating conveyor 10 when the container 30 is in the usage position.

This being the case, the loading module 26 comprising a container 30 and an elevating conveyor 10 mounted movably as a whole inside the container 30 is particularly advantageous.

Thus, in general, the invention also relates to a loading module of an asphalt mixing plant, comprising a normalized transport container and an elevating conveyor mounted movably on the container between a transport position in which the elevating conveyor is lowered relative to the container received inside the container and a usage position in which the elevating conveyor is raised relative to the container, and a placement device for keeping the conveyor in the usage position and/or for moving the elevating conveyor relative to the container between the transport position and the usage position.

Such a loading module may for example comprise one or several of the following optional features:

- the elevating conveyor is mounted pivoting on the container, the placement device comprising an articulation connecting the elevating conveyor to the container:
- the placement device comprises at least one actuator configured to move the elevating conveyor relative to the container between the transport position and the usage position;
- the conveyor comprises two doors arranged in the two opposite side walls to allow the passage of a vehicle through the container, below an upper end of the conveyor;
- the loading module comprises a storage hopper mounted at one end of the elevating conveyor;
- the storage hopper is movable between transport position folded against the elevating conveyor and an unfolded usage position to receive aggregates poured by the elevating conveyor.

Providing a drying module incorporating a placement device making it possible simultaneously to lift the drying module and a filtering module stacked on the drying module facilitates the installation of the asphalt mixing plant, by making it possible to unload the filtering module onto the drying module using the transport truck without using a separate lifting vehicle such as a crane, before lifting the drying module and the filtering module together to the desired height using the placement device integrated into the drying module.

Thus in general, the invention relates to an asphalt mixing plant comprising transportable modules including two modules configured to be stacked on one another, in particular a drying module and a filtering module, the module provided to be positioned below the other having an integrated placement device comprising at least one actuator configured simultaneously to lift both modules stacked one on the other.

Providing a placement device having separate actuators and retractable feet is advantageous in terms of ease of use and reliability.

Thus in general, the invention relates to a transportable module for an asphalt mixing unit, comprising a normalized transport container and at least one primary piece of equipment integrated into the normalized transport container, each primary piece of equipment being chosen from among metering hoppers, a drying drum, a filtering device, an elevating conveyor and a storage hopper, the module comprising a placement device integrated into the container and comprising at least one actuator configured to lift the container as a whole to a desired height relative to the ground and retractable feet separate from the actuators making it possible to keep the container at the desired height relative to the ground.

The invention claimed is:

1. A transportable loading module for an asphalt mixing plant, the transportable loading module comprising a normalized transport container (30), an elevating conveyor (10) installed permanently in the container (30) while being at least partially mounted movably on the container (30) between a transport position in which the elevating conveyor (10) is lowered relative to the container (30) and received inside the container and a usage position in which the elevating conveyor (10) is raised relative to the container, and a storage hopper (12) configured to receive and store asphalts poured by the elevating conveyor (10) during use, and in which the container (30) comprises two doors (72) arranged opposite one another in two opposite side walls (70) of the container (30), the opening of the doors (72) making it possible to arrange a passage for a vehicle through the container (30), the passage passing below the storage hopper (12), for the loading of the vehicle with asphalts poured by the elevating conveyor (10).

2. The loading module according to claim 1, wherein the elevating conveyor (10) comprises a stationary part mounted stationary on the container (30) and a moving part mounted moving on the container (30) to move from the transport position to the usage position of the elevating conveyor (10).

3. The loading module according to claim 2, wherein the elevating conveyor (10) is mounted movably as a whole relative to the container (30).

4. The loading module according to claim 1, comprising a placement device configured to keep the elevating conveyor (10) in the usage position relative to the container (10) and/or to move the elevating conveyor (10) relative to the container (30) between the transport position and the usage position.

5. The loading module according to claim 1, comprising an actuator configured to move the elevating conveyor (10) from the transport position to the usage position.

6. The loading module according to claim 1, comprising an articulation assembly (60) connecting the elevating conveyor (10) to the container (30) such that the elevating conveyor (10) is mounted rotatably on the container (30) between the transport position and the usage position.

7. The loading module according to claim 1, wherein the storage hopper (12) is mounted on the end of the elevating conveyor (10) that is raised relative to the other when the elevating conveyor (10) is in the usage position.

8. The loading module according to claim 1, wherein the storage hopper (12) is mounted movably on the elevating conveyor (10) between a folded position for transport and an unfolded usage position, the storage hopper (12) in the folded position being folded down against the elevating conveyor (10) to make it possible to lower the elevating conveyor (10) into the transport position thereof.

9. A plant for mixing asphalt from aggregates, the asphalt mixing plant comprising a loading module according to claim 1.

10. The asphalt mixing plant according to claim 9, comprising a drying module (22) comprising a normalized transport container and a drying drum (6) mounted inside the container, and a filtering module (24) comprising a normalized transport container and a filtering device (8) mounted inside the container, the filtering module (24) being configured to be stacked on the drying module (22), with connecting a hot gas manifold (50) positioned at an outlet end of the drying drum (6) to an inlet of the filtering device (8).

11. The asphalt mixing plant according to claim 10, wherein the drying module (22) comprises a placement device (36) incorporated into the drying module (22) and configured to simultaneously lift the drying module (22) and the filtering module (24) stacked on the drying module (22).

12. The asphalt mixing plant according to claim 9, wherein at least one of the modules comprises a placement device incorporated into the module, the placement device comprising actuators (54) to lift the container (30) of the module relative to the ground and retractable feet (52) provided to keep the container (30) raised relative to the ground.

13. The asphalt mixing plant according to claim 12, wherein the actuators (54) of the device for placement of a module are arranged to act on the feet (52) of the placement device of the module.

14. The asphalt mixing plant according to claim 12, wherein the actuators (54) of the device for placement of a module are separate from the feet (52) of the placement device of the module.

15. The loading module according to claim 2, comprising a placement device configured to keep the elevating conveyor in the usage position relative to the container and/or to move the elevating conveyor relative to the container between the transport position and the usage position.

16. The loading module according to claim 3, comprising a placement device configured to keep the elevating conveyor in the usage position relative to the container and/or to move the elevating conveyor relative to the container between the transport position and the usage position.

17. The loading module according to claim 2, comprising an actuator configured to move the elevating conveyor from the transport position to the usage position.

18. The loading module according to claim 3, comprising an actuator configured to move the elevating conveyor from the transport position to the usage position.

19. The loading module according to claim 4, comprising an actuator configured to move the elevating conveyor from the transport position to the usage position.

20. The loading module according to claim 2, comprising an articulation assembly connecting the elevating conveyor to the container such that the elevating conveyor is mounted rotatably on the container between the transport position and the usage position.

* * * * *